US007648180B2

(12) United States Patent
Petry

(10) Patent No.: US 7,648,180 B2
(45) Date of Patent: Jan. 19, 2010

(54) SECURING BOLT DOOR LOCK

(76) Inventor: Robert W. Petry, 4390 N. Riverside Dr., Columbus, IN (US) 47203

( * ) Notice: Subject to any disclaimer, the term of this patent is extended or adjusted under 35 U.S.C. 154(b) by 0 days.

(21) Appl. No.: 12/389,781

(22) Filed: Feb. 20, 2009

(65) Prior Publication Data

US 2009/0151408 A1 Jun. 18, 2009

Related U.S. Application Data

(62) Division of application No. 11/657,334, filed on Jan. 24, 2007, now abandoned.

(51) Int. Cl.
*E05C 1/02* (2006.01)
*E05B 15/02* (2006.01)

(52) U.S. Cl. ..... 292/137; 292/145; 292/146; 292/150; 292/340; 292/341

(58) Field of Classification Search ..... 292/137, 292/145, 146, 150, 340, 341; 70/54
See application file for complete search history.

(56) References Cited

U.S. PATENT DOCUMENTS 15,094 A * 6/1856 Warner ..... 292/145
1,245,049 A * 10/1917 Silverstein ..... 292/145
4,482,177 A * 11/1984 Nagy ..... 292/156
4,815,774 A * 3/1989 Correnti ..... 292/145
4,949,560 A * 8/1990 Anderson ..... 70/54
5,074,606 A * 12/1991 Priola et al. ..... 292/346
5,080,354 A * 1/1992 McDougall ..... 292/145
5,125,695 A * 6/1992 Hartwell ..... 292/62
5,427,422 A * 6/1995 Madlener et al. ..... 292/264
6,679,530 B2 * 1/2004 Krynski ..... 292/210
7,021,678 B1 * 4/2006 Raoult ..... 292/63

FOREIGN PATENT DOCUMENTS

GB 2108568 A * 5/1983
GB 2275961 A * 9/1994

* cited by examiner

*Primary Examiner*—Carlos Lugo
(74) *Attorney, Agent, or Firm*—Woodard, Emhardt, Moriarty, McNett & Henry LLP

(57) ABSTRACT

A lock assembly for securing a movable panel in a locked condition relative to an adjacent stationary frame, according to one embodiment of the present invention, includes a first plate defining a pair of first receiving apertures and being constructed and arranged with a first mounting portion having a substantially planar mounting surface for being attached to the movable panel, a second plate defining a pair of second receiving apertures and being constructed and arranged with a second mounting portion having a substantially planar mounting surface for being attached to the stationary frame, a pair of locking members constructed and arranged for insertion through a corresponding pair of the first and second receiving apertures when the movable panel is closed relative to the stationary frame and wherein the substantially planar mounting surface of the first mounting portion is substantially parallel with and facing the substantially planar mounting surface of the second mounting portion.

7 Claims, 6 Drawing Sheets

SECURING BOLT DOOR LOCK

CROSS REFERENCES TO RELATED APPLICATIONS

This application is a divisional of application Ser. No. 11/657,334, filed Jan. 24, 2007 now abandoned, which is hereby incorporated by reference.

BACKGROUND OF THE INVENTION

The present invention relates in general to door locking systems that include a movable securing bolt or shackle. More specifically, the present invention relates to a movable securing bolt door lock that includes a first locking plate that is constructed and arranged to attach to the door and a second locking plate that is constructed and arranged to attach to the door frame. The disclosed structure allows the first locking plate to be used as part of a movable panel, whether a door or otherwise, while the second locking plate would be attached to the surrounding, stationary, frame portion that cooperates with that movable panel.

One style of securing bolt lock that is currently in use includes a bolt plate that is attached to the door, a bolt-receiving plate that is attached to the door frame, and a sliding bolt. Depending on the style of door, the style of the door frame, and the available space, the bolt plate can be attached instead to the door frame. If this change is made, then the bolt-receiving plate is attached instead to the door.

Regardless of the particular arrangement of these two portions the bolt plate includes a sleeve with locking notches for stowing the bolt handle. Although there may be various design options and minor modifications to this described basic structure, the same attachment scheme is practiced. This attachment scheme involves the use of threaded fasteners that are inserted through clearance holes in the two plates and then screwed directly into the inner face of the door panel and on the other side into the inner face of the door frame, respectively. As used in this context, "inner" refers to that surface that faces into the interior of the room or structure. Unfortunately, this attachment scheme requires the drilling of pilot holes directly into the door and into the door frame and the strength of the lock is dependent in part on the holding strength of the selected fasteners, likely wood or self-tapping screws, within the wood or other receiving material. This manner of attachment is not preferred, as the greatest strength of the attaching screws is loaded in shear rather than in push out, particularly when the door and door frame are fabricated from wood and the condition of that wood may be suspect. By configuring the plates and the attachment scheme as disclosed herein, an improved securing bolt door lock is described.

The present description refers to a "securing bolt" in lieu of a "sliding bolt", since the disclosed construction does not require any type of "sliding" action, even if that might be the most convenient construction. Further, a "bolt" is not required as that component can be substituted with any type of bar or rod or lock-type shackle, to name some of the construction options for connecting together the two plates.

BRIEF SUMMARY

A lock assembly for securing a movable panel in a locked condition relative to an adjacent stationary frame, according to one embodiment of the present invention, comprises a first plate defining a pair of first receiving apertures and being constructed and arranged with a first mounting portion having a substantially planar mounting surface for being attached to the movable panel, a second plate defining a pair of second receiving apertures and being constructed and arranged with a second mounting portion having a substantially planar mounting surface for being attached to the stationary frame, a pair of locking members constructed and arranged for insertion through a corresponding pair of the first and second receiving apertures when the movable panel is closed relative to the stationary frame and wherein the substantially planar mounting surface of the first mounting portion is substantially parallel with and facing the substantially planar mounting surface of the second mounting portion.

One object of the present disclosure is to provide an improved lock assembly.

DETAILED DESCRIPTION

Figure 1:
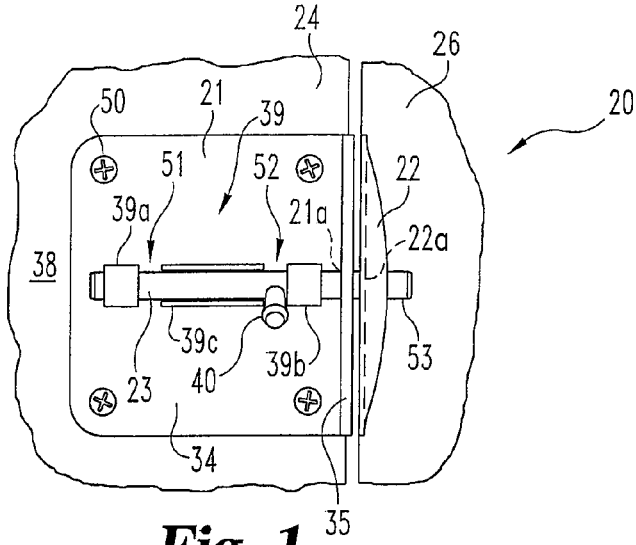
FIG. 1 is a front elevational view of a lock assembly in a closed and locked condition according to a typical embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 1A:
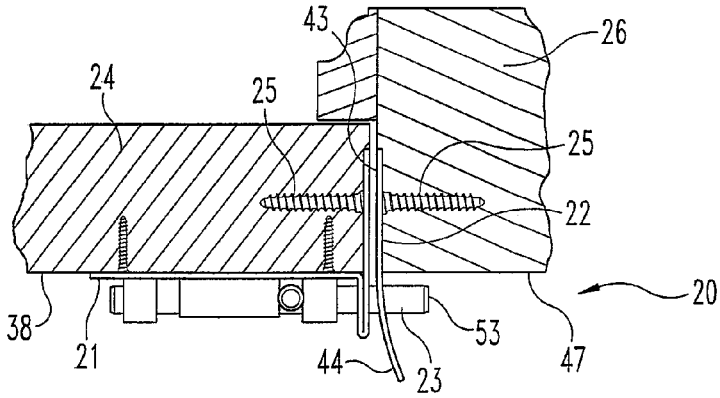
FIG. 1A is a partial, top plan view of the FIG. 1 lock assembly.
Figure 1B:
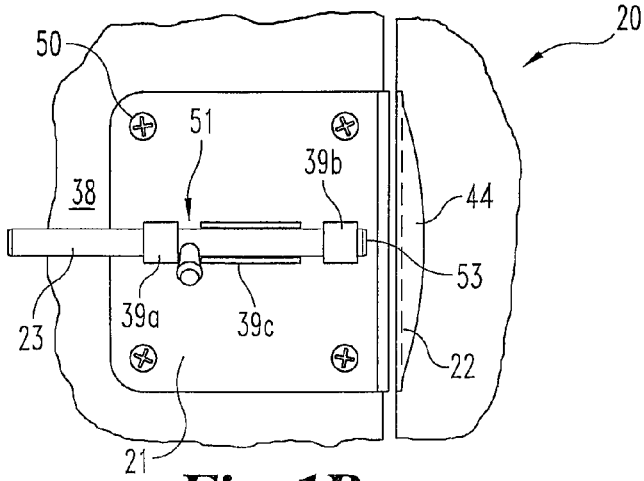
FIG. 1B is a front elevational view of the FIG. 1 lock assembly in a closed and unlocked condition.

Referring to FIGS. 1, 1A, 1B, 2, and 3, there is illustrated a sliding bolt door lock 20 that includes two cooperating plates 21 and 22 and a securing bolt 23. Plate 21 is securely attached to the door 24 by screws 25 (or by similar threaded fasteners), tightly threaded into facing side 24*a*. Plate 22 is securely attached to the door frame 26 by screws 25 (or by similar threaded fasteners), tightly threaded into facing side 26*a*. When door 24 is in a closed condition relative to door frame 26, facing side 24*a* and facing side 26*a* are substantially parallel to each other. FIGS. 1 and 1A illustrate a closed and locked condition for door 24 and lock 20 relative to door frame 26. As is illustrated, door 24 is actually closed into alignment with the door frame 26 such that the door is adjacent to the door frame consistent with how a door closes relative to a door frame. FIG. 1B illustrates a door closed but unlocked condition for door 24 and lock 20 relative to door frame 26. Plate 21 is illustrated in greater detail in FIGS. 2 and 4. Plate 22 is illustrated in greater detail in FIGS. 3 and 5. Each plate 21 and 22 defines a bolt-receiving clearance aperture in the form of holes 21*a* and 22*a*, respectively.

With continued reference to FIGS. 1, 1A, 1B and 2, it will be understood that plate 21 is positioned on and attached to door 24 generally at the location of the door handle (not illustrated) and where the latch face plate would be positioned. Plate 22 is positioned on and attached to the door frame 26 at the location where the conventional strike latch plate would be positioned. In the illustrations of FIGS. 1-10, the conventional latch face plate and strike latch plate have been removed. However, it should also be understood that the disclosed plates 21 and 22 provide structures that can be used with the latch face plate and the strike latch plate, respectively, or can be used without those additional portions provided.

Figure 10:
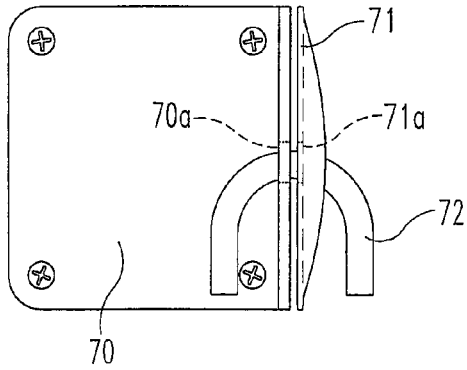
FIG. 10 is a front elevational view of the FIG. 1 lock assembly with an alternately styled locking member according to the present invention.

When the door 24 is closed, as is illustrated in FIG. 1, the two plates 21 and 22 are aligned with each other such that their corresponding bolt-receiving clearance holes 21*a* and 22*a* are horizontally aligned and constructed and arranged to receive securing bolt 23, or a similar component that hooks through these two holes, see FIG. 10. When the securing bolt 23 is inserted through the two holes 21*a* and 22*a*, see FIGS. 1 and 1A, the door 24 is in a locked condition. When the bolt 23 is not inserted through the two holes 21*a* and 22*a*, the door 24 is not in a locked condition (see FIG. 1B), even when the door 24 is closed into position adjacent the door frame 26, as is illustrated.

Figure 2:
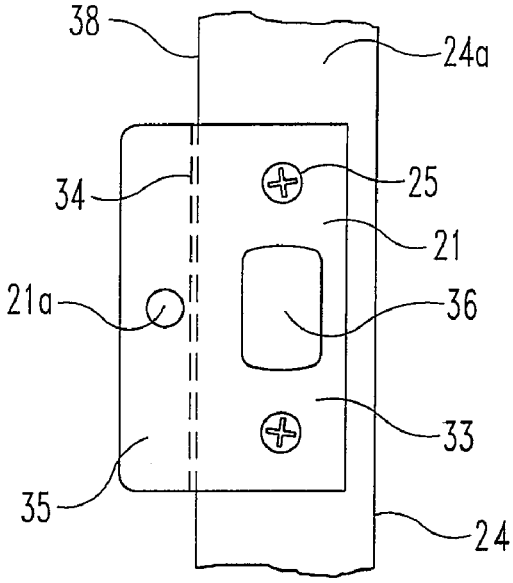
FIG. 2 is a right side elevational view of one plate comprising a portion of the FIG. 1 lock assembly.
Figure 4:
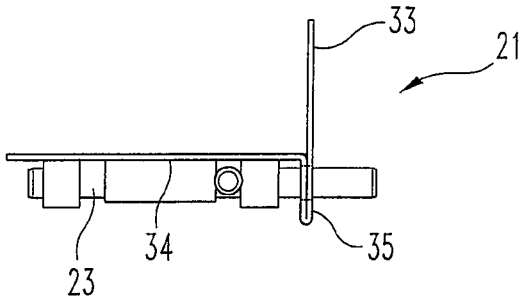
FIG. 4 is a bottom plan view of the FIG. 1 lock assembly in the closed and locked condition.

Referring to FIGS. 2 and 4, plate 21 is a unitary, preferably metal, component that in a bottom plan view (see FIG. 4) has a T-shaped configuration including, as its three potions or panels, a facing door panel 33, an outer door panel 34, and a securing panel 35 that defines the bolt-receiving hole 21*a*. Plate 21 is constructed and arranged to be attached at the location of the conventional latch face plate and panel 33 defines an aperture 36 that provides clearance for the conventional door latch. Panel 33 is securely attached directly to door facing side 24*a* by two screws 25 (see FIG. 2). A four-corners pattern of attaching screws 25 is also contemplated if four screws 25 are to be used in lieu of only two screws. Panel 34 is in tight engagement against door face 38 and panel 35 extends away from the door face 38 in a substantially perpendicular direction to the planar surface of the door face (see FIG. 4). Panel 34 is preferably constructed and arranged with a sliding bolt sleeve 39 of conventional construction in terms of the tubular construction with positioning notches for the bolt knob 40. It will also be noted that panel 33, which is substantially planar, is positioned so as to face a corresponding and substantially planar portion of plate 22 when door 24 is closed in adjacent alignment with door frame 26. These substantially planar facing portions are substantially parallel to each other.

Figure 3:
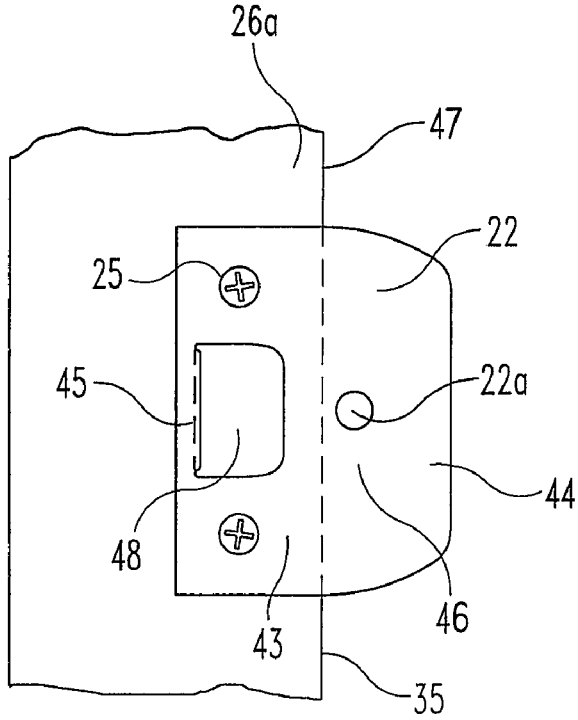
FIG. 3 is a left side elevational view of a second plate comprising one portion of the FIG. 1 lock assembly.
Figure 5:
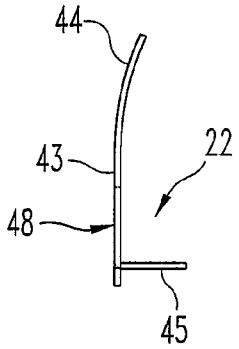
FIG. 5 is a bottom plan view of the FIG. 3 second plate.

Referring to FIGS. 3 and 5, plate 22 is a unitary, preferably metal component that, in a bottom plan view (see FIG. 5), has a planar body 43, a curved front lip 44, and a latch lip 45. The planar body 43 defines a bolt receiving hole 22*a* and aperture 48 for receipt of the door latch (not illustrated). In order for hole 22*a* to be horizontally aligned with hole 21*a* for receiving securing bolt 23, the hole 22*a* location is positioned between front lip 44 and aperture 45.

Planar body 43 is securely attached directly to door frame facing side 26*a* by two screws 25, see FIG. 3. A four-corners pattern of attaching screws 25 is also contemplated if four screws 25 are to be used in lieu of only two screws. Planar body 43 is in tight engagement against facing side 26*a* and the outer portion 46 that is adjacent front lip 44 extends outwardly away from planar frame surface 47. Planar body 43 is substantially perpendicular to frame surface 47. In order to configure door 24 in the locked condition of FIG. 1, the door 24 is closed against the door frame 26 and securing bolt 23 is moved to the right so as to extend through hole 21*a* and then through hole 22*a*.

As described, outer door panel 34 is secured to the door face 38 by optional screws 50 and outer door panel 34 includes sliding bolt sleeve 39. Sliding bolt sleeve 39 is constructed and arranged with a first enclosed sleeve 39*a*, a second, spaced-apart enclosed sleeve 39*b*, and therebetween an open sleeve 39*c*. Clearance notch 51 is defined between sleeves 39*a* and 39*c* and clearance notch 52 is defined between sleeves 39*b* and 39*c*. Securing bolt 23 is substantially cylindrical with a bolt knob 40 extending outwardly from the main body of bolt 23. As would be understood, the presence of bolt knob 40 prevents the securing bolt from moving too far in either direction, either to the left or to the right. Once the bolt knob 40 abuts up against the left end of sleeve 39*b*, its sliding movement to the right stops. At this point the bolt knob 40 is aligned with clearance notch 52. Moving knob 40 down into clearance notch 52 rotates the securing bolt 23 on axis. This movement then secures bolt 23 in its locked position, as is illustrated in FIG. 1.

For the unlocked position of FIG. 1B, the bolt knob 40 is positioned in clearance notch 51. In order to do so, the bolt 23 has to slide to the left. This movement pulls the free end 53 of bolt 23 out of engagement with bolt-receiving hole 22*a* (first) and then bolt-receiving hole 21*a* (second). Placement of knob 40 into notch 51 secures the bolt in the unlocked condition.

As described generally in the Background, the typical style of sliding bolt lock includes a plate with the bolt and bolt sleeve that mounts to the inwardly (i.e., into the room) facing surface 38 of the door. A cooperating plate mounts to the inwardly facing frame surface 47. These two plates are connected together by the bolt extending through the receiving holes into the described locking engagement. Any attempt to open the door by pushing it inwardly, into the interior of the room or structure, pushes against the two plates. The strength of the securing bolt door lock is generally considered to be defined by the holding strength of the screws that are used to mount the two plates to the inwardly-facing surfaces, i.e., the surfaces of the door and the frame that are facing inwardly into the room. Accordingly, the opening force is generally parallel with the long axis of the mounting screws and thus their holding strength is based more on their resistance to being pushed out of the receiving material of the door or frame, typically wood, than anything else.

In contrast, the present disclosure creates another plate portion or section for each plate that attaches directly to the facing side 24 of the door and to the facing side 26 of the frame. Rather than these surfaces being directed inwardly, such that they are parallel to the interior of the room, they are instead perpendicular. The mounting screws 25 are threaded into position such that the long axis of each screw is now substantially perpendicular to the direction of the opening force that would be applied against the door. In order to defeat the door lock as described herein, it is expected that these mounting screws would have to fail in shear, a force requirement that is substantially greater than the push out force when the opening force is parallel to the long axis of the mounting screws. The push out force is also reduced in the prior art construction as the density and hardness of the wood decreases and as the condition of the wood deteriorates.

Figure 6:
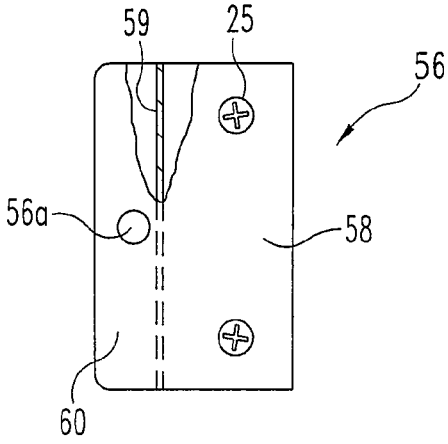
FIG. 6 is a right side elevational view of a first plate according to an alternative embodiment of the present invention.
Figure 7:
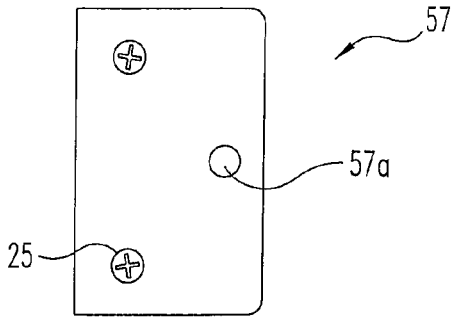
FIG. 7 is a left side elevational view of a second plate according to an alternative embodiment of the present invention.

Referring to FIGS. 6 and 7, alternative embodiments of the two plates of the disclosed securing bolt door lock are illustrated. Plate 56 (see FIG. 6) is constructed and arranged to attach to the door 24 and represents an alternative design to plate 21. Plate 57 (see FIG. 7) is constructed and arranged to attach to the door frame 26 and represents an alternative design to plate 22.

As should be understood, when the lock 20 is positioned relative to the door frame at or at least adjacent the location of the latch, strike plate, etc., a clearance aperture in each plate must be provided for the latch. This is why aperture 36 is defined by panel 33 of plate 21 and this is why aperture 48 is defined by planar body 43 of plate 22. This particular attachment location for plates 21 and 22 is also why lip 44 and lip 45 are provided. However, it should also be understood that the plate designs disclosed herein can be used, as a matched set, at locations above and/or below the conventional door latch location. When clearance apertures and lips do not need to be provided for the latch, these features can be eliminated from the cooperating plates and this is illustrated by alternative design plates 56 and 57. Accordingly, plate 56 is substantially identical to plate 21 except that aperture 36 is omitted. Plate 57 is substantially identical to plate 22 except that aperture 48 is omitted and lips 44 and 45 are removed. The bolt-receiving hole 57*a* is horizontally aligned with hole 56*a* for receipt of the securing bolt 23. Plate 56 is constructed and arranged to be securely attached to the door and includes, as its three panels, a facing door panel 58, an outer door panel 59, and a securing panel 60 that defines bolt-receiving hole 56*a*. A four-hole pattern for the mounting screws 25 may be provided as part of panel 58 in lieu of the illustrated two-hole pattern for the mounting screws. The alternative mounting patterns can also be provided for plate 57. The securing bolt 23, bolt sleeve 39, and bolt knob 40 remain the same as already described and are assembled to outer door panel 59 (though not illustrated in FIG. 5) in the same manner and arrangement as that illustrated in FIGS. 1, 1A, 1B and 4.

Figure 8:
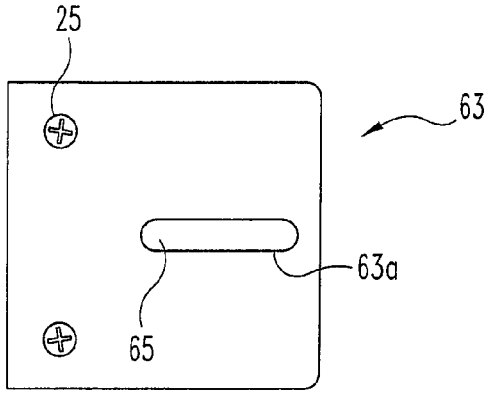
FIG. 8 is a left side elevational view of a second plate according to an alternative embodiment of the present invention.
Figure 8A:
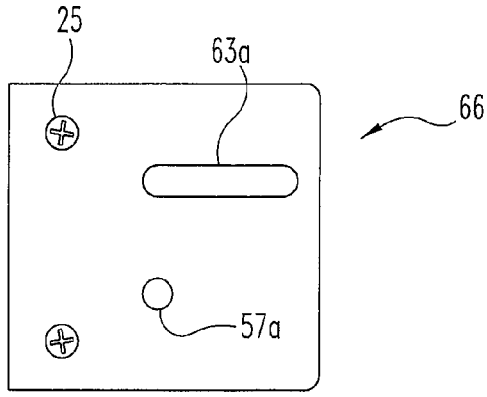
FIG. 8A is a left side elevational view of a second plate according to another alternative embodiment of the present invention.
Figure 9:
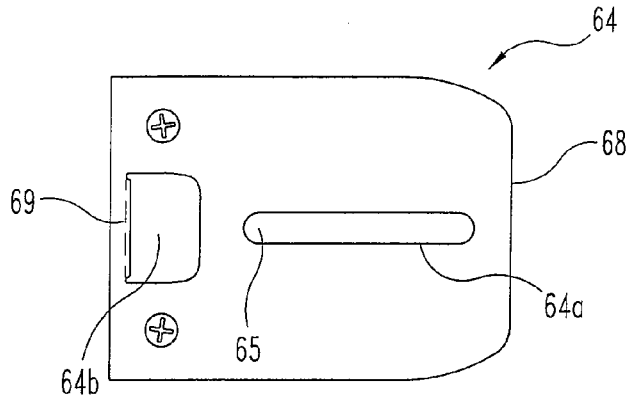
FIG. 9 is a left side elevational view of a second plate according to an alternative embodiment of the present invention.
Figure 9A:
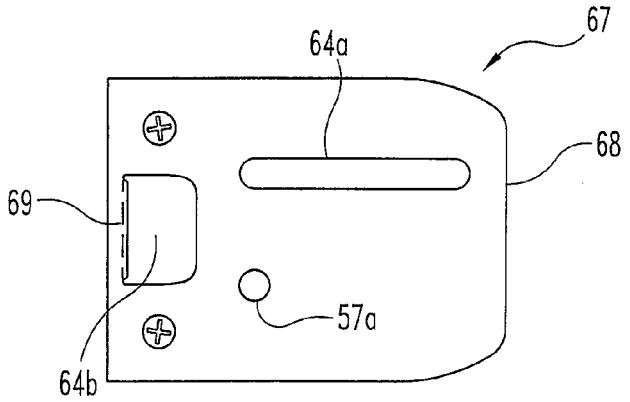
FIG. 9A is a left side elevational view of a second plate according to another alternative embodiment of the present invention.

Referring now to FIGS. 8, 8A, 9, 9A, and 11, four other design alternatives are illustrated for the plate that is attached to the door frame, i.e., plate 22 in FIG. 1 and plate 57 as in FIG. 7. Since the door plates 21 and 56 are movable with the movement of the door, these first plates are described as being a movable plate. The door frame plates 22, 57, and 63 (see FIG. 8) and 64 (see FIG. 9) are securely attached to the stationary door frame. As such, these second plates are described as being a stationary plate. Further stationary plate alternatives 66 and 67 are illustrated in FIGS. 8A and 9A, respectively. The FIG. 11 arrangement is used with either stationary plate 66 or stationary plate 67.

Referring to FIGS. 1 and 8, it will be understood that any attempt to swing open the door 24 ("open" meaning out of the plane of the paper) causes the bolt 23 to be held or captured by its receipt within the bolt-receiving hole 22*a* of the stationary plate 22. The opening-attempt force applied to the door translates into an abutment force, against the edge of hole 22*a*, but the strength of the mounting screws 25 into the door frame, prevents the door from opening. When the bolt-receiving hole 22*a* or 57*a* is changed to a slot, such as slot 63*a* in plate 63 or slot 64*a* in plate 64, limited movement (i.e., partial opening) of the door is permitted. If end 65 represents the aligned location for the bolt with the door fully closed, then the degree of partial opening that is possible corresponds to the length of slots 63*a* and 64*a*. The free end of bolt 23 simply moves in the corresponding slot as the door is partially opened. This structure permits the owner/occupant to open the door slightly (i.e., ajar) and be able to peek through the crack between the door and the door frame and see who is requesting entry into the room or structure.

FIG. 8 illustrates the second plate 63 construction when the door lock is not being attached at a location adjacent the latch. FIG. 9 illustrates the second plate 64 construction when the door lock is being attached at a location adjacent the latch. As such, plate 64 includes the curved front lip 68, the latch lip 69, and the latch opening 64*b*.

Figure 11:
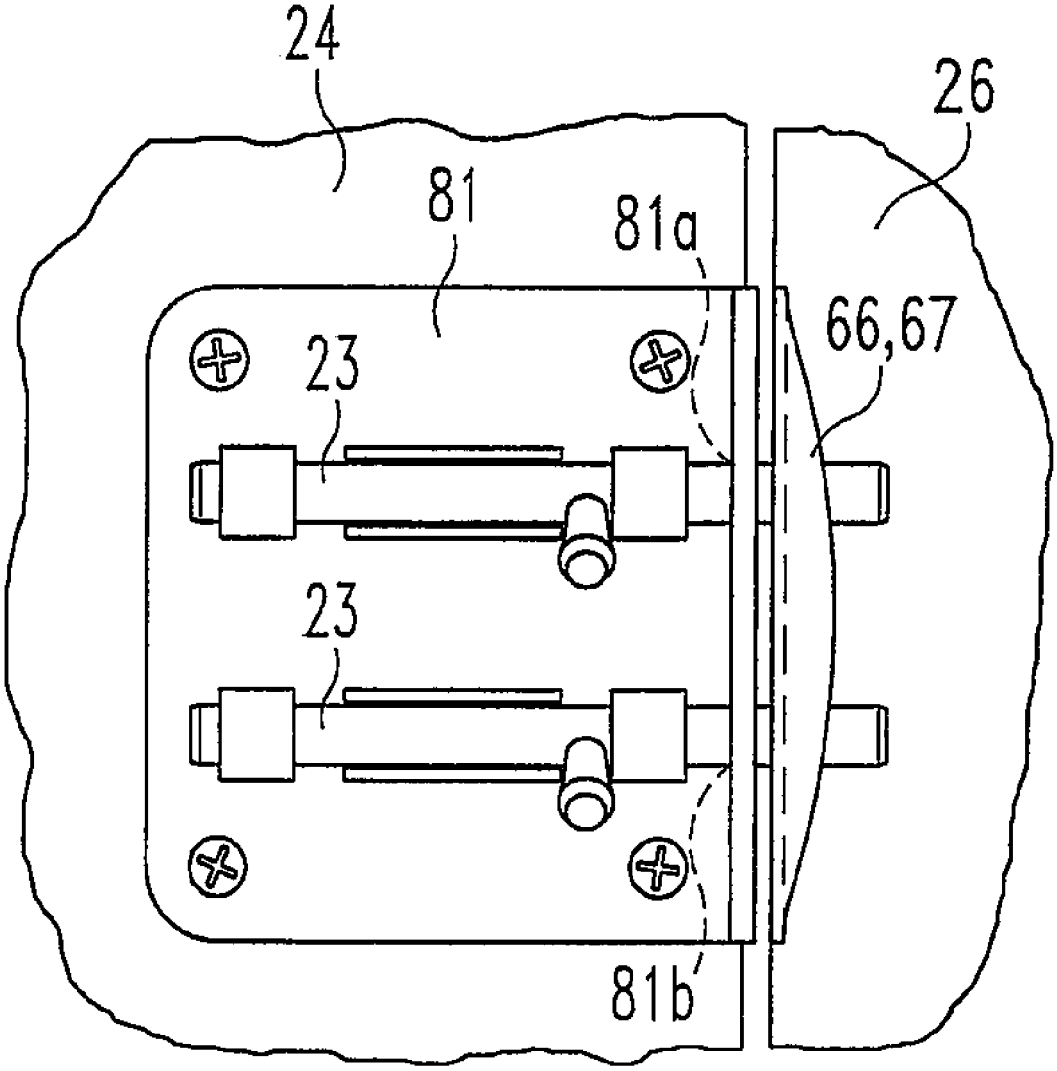
FIG. 11 is a front elevational view of the pair of bolts that would be used with either the FIG. 8A or FIG. 9A embodiment.

Referring now to FIGS. 8A and 9A, it is noted that there could be a desire to have a door lock structure that permits a choice between the hole 57*a* option and the slot 63*a* option. The FIG. 8A structure of plate 66 provides these two options in a single plate for the non-latch style. The FIG. 9A structure of plate 67 provides these two options in a single plate for the latch style. FIG. 11 illustrates the stack of two bolts 23 to be used with either plate 66 or 67. The cooperating plate 81 would of course include two aligned and cooperating bolt-receiving holes 81*a* and 81*b*.

If a shackle 72 is used as illustrated in FIG. 10, then the cooperating plate does not need to be changed in either structure or location. The user could simply slide the shackle through the receiving hole in the plate attached to the door and select one or the other of the apertures in either plate 66 or plate 67, specifically either hole 57*a* or slot 63*a*. If there would be a need to provide a pair of shackles, then an additional hole in the door plate would be required. This particular construction allows the user to secure the door against the frame without any opening movement being permitted by the use of hole 57*a*. Removing the shackle 72 from hole 57*a* then allows the door to be moved slightly while still securing the door to the frame by the use of a shackle extending through slot 63*a*.

If the sliding bolt construction is used, there are two primary options. One option is to align the bolt with the desired opening, either hole 57*a* or slot 63*a* in the case of FIG. 8A, and either hole 57*a* or slot 64*a* in the case of FIG. 9A. The other option is to space the hole and slot far enough apart to provide room for the use of two sliding bolts, one aligned with the hole and the other aligned with the slot. The use of two sliding bolts provides the maximum versatility such that the door can be kept secured against the frame using hole 57*a*. Even if that sliding bolt is removed, the door is still secured by the use of the sliding bolt inserted into slot 64*a*. This bolt arrangement is illustrated in FIG. 11.

Referring now to FIG. 10, the securing bolt 23 and its cooperating bolt sleeve 39 structure are removed from the first movable plate 70. Plate 70 is identical to plate 21 when positioned at the latch location and is identical to plate 56 when not positioned at the latch location, except that the securing bolt and its sleeve structure are removed. The second stationary plate 71 is unchanged from any of the embodiments disclosed for the second plate, the specific selection of plate style depending on location and whether or not there is a desire to be able to be able to open the door partially. In order to secure the two plates 70 and 71 together into a door-locked configuration, a shackle 72 is inserted through the shackle-receiving apertures 70*a* and 71*a*.

It is anticipated that the nature of the door and the door frame, including materials, condition, size, and degree of security desired will influence the number and size of attachment screws 25. These variables will also influence the size, thickness, and materials for the first and second plates. All of these types of variations are anticipated and contemplated for the structures disclosed herein. Further, while the preferred embodiment has been described in the context of a door and door frame, the disclosed structure is fully suitable with any type of movable (openable) panel and its adjacent and cooperating, stationary panel frame.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. In combination:

a door frame having a facing side;

a door constructed and arranged to cooperate with said door frame, said door having a facing side, wherein said door is closable relative to said door frame and wherein when said door is in a close condition relative to said door frame, the facing side of the door frame is substantially parallel with the facing side of the door; and a lock assembly for securing said door in a locked condition relative to said door frame, said lock assembly comprising:

a first plate defining first and second receiving apertures, said first plate being constructed and arranged with a first mounting portion which is attached to facing side of said movable panel door;

a second plate defining third and fourth receiving apertures, said second plate being constructed and arranged with a second mounting portion which is attached to the facing side of said door frame, said fourth receiving aperture is a slot with first and second ends; and a pair of movable securing bolts mounted on said first plate and being movable into engagement with said second plate;

wherein, when the first receiving aperture is aligned with said third receiving aperture and said second receiving aperture is aligned with said first end of said slot, said pair of movable securing bolts can be moved through their respective apertures to fully close said door with respect to said door frame or by only moving the securing bolt aligned with said second receiving aperture and said first end of said slot through the apertures, so that when said door is moved in an open direction, the securing bolt will move from said first end toward said second end of said slot, permitting partial opening of said door while still preventing complete opening of said door.

2. The combination of claim 1 wherein said first mounting portion having a substantially planar mounting surface for being attached to said door.

3. The combination of claim 2 wherein said second mounting portion having a substantially planar mounting surface for being attached to said door frame.

4. The combination of claim 3 wherein said first mounting portion defining a mounting hole pattern for receipt of threaded fasteners.

5. The combination of claim 4 wherein said second mounting portion defining a mounting hole pattern for receipt of threaded fasteners.

6. The combination of claim 5 wherein said first plate is constructed and arranged to define a latch opening.

7. The combination of claim 6 wherein said second plate is constructed and arranged to define a latch opening.

* * * * *